United States Patent [19]

Chen

[11] Patent Number: 4,787,284

[45] Date of Patent: Nov. 29, 1988

[54] CUTTING APPARATUS FOR WRAP FILM

[76] Inventor: Shing-Huei Chen, 3 Fl., No. 6, Lane 10, Sec. 2 Chung-Cheng Rd., Shih-Lin, Taipei, Taiwan

[21] Appl. No.: 50,247

[22] Filed: May 14, 1987

[51] Int. Cl.[4] ..... B26D 5/10

[52] U.S. Cl. ..... 83/614; 83/649

[58] Field of Search ..... 83/614, 649

[56] References Cited

U.S. PATENT DOCUMENTS

| | | | |
|---|---|---|---|
| 3,142,217 | 7/1964 | Busse | 83/614 |
| 3,236,427 | 2/1966 | Martin | 83/649 |
| 3,370,497 | 2/1968 | Busse | 83/614 |
| 3,688,625 | 9/1972 | Thomas et al. | 83/614 |
| 4,156,382 | 5/1979 | Baker | 83/614 |
| 4,197,774 | 4/1980 | Singh et al. | 83/374 |

*Primary Examiner*—Frank T. Yost
*Assistant Examiner*—Eugenia A. Jones

[57] ABSTRACT

An improved cutting apparatus for all household plastic wrap film comprises a sliding saddle mounted in a guiding track slot on the top of a cardboard dispenser box. Since the sliding saddle is mounted with a safety razor, the wrap film can be cut into a desired piece by the safety razor when the film is pulled out of the cardboard dispenser box.

1 Claim, 6 Drawing Sheets

CUTTING APPARATUS FOR WRAP FILM

BACKGROUND OF THE INVENTION

This invention is an improvement of the previous application No. 930,358 filed by the same inventor (applicant).

Since the living standards of our society has been improved and lifted up considerably in the recent years, the people have given particular emphasis and attention to the sanitation and freshness of food. In addition to using refrigerators and other freezers, a lot of wrap film have been used by many families to maintain the freshness, the moisture of the foods and to keep the foods from having different smell. The current wrap films in the market are mainly made of PE plastic material, which has the advantages of transparency, softness, extensibility and adhesiveness. With a given length and width, the wrap film is usually rolled around a cardboard shaft; then, both of them are packed in a dispenser box to become an end item. One side of the dispenser box is mounted with a serrated strip for tearing the film.

The operation method of the wrap film is generally printed on the dispenser box, and it is described briefly as follows (shown in FIG. 1):

1. Hold the dispenser box with the left hand.

2. Pull one end of the wrap film out of the dispenser box with the right hand, cross and cover a food container, and let the film adhere around the edge portion of the food container by means of the adhesiveness of the film.

3. Hold the food container with the right hand, and hold the dispenser box with the left hand. Tear the film with the serrated strip by applying a force with two hands but in different directions, or hold the dispenser box with the left hand, and the right hand is free from the food container after one end of the film is adhered to the food container; then, hold the film on the portion along the serrated strip with the right hand. The both hands apply forces in different directions to tear off the film with the serrated strip.

The drawbacks of the current method of tearing off the wrap film:

According to the aforesaid method of tearing off a film, the physical nature of the wrap film, the facts, the experiences of tearing off the film, and the drawbacks of that method are as follows:

1. Since the material of the wrap film has the features of being thin, soft, transparent, air-tight and adhesive, it also has a considerable extensibility; therefore, upon the application of forces in different directions to tear off the film with the serrated strip by both hands, the line of tearing is rather difficult to be controlled in a correct direction desired as a result of the extensibility of the film, in other words, the tearing line can not be controlled precisely, and therefore the dimensions of the film to be torn off can not be controlled exactly. It not only wastes some portion of the wrap film, but also causes an inconvenience.

2. After the wrap film being torn off with the serrated strip by both hands, the film would retract and shrink to some extent as a result of its extensibility; that would cause much inconvenience to the user.

3. Upon using the metal serrated strip to tear off the wrap film, the user's finger is susceptible to being injured upon careless applying force; further, the sharp and protrudent serrated edge might cause accident and injure the children upon being played because of the improper storage of the wrap film.

Conclusively speaking, most of the users of the wrap film dislike of the method of using the serrated strip to tear off the film because of its inconvenience, unsafe nature, and the user's unpleasant experience of being injured.

SUMMARY OF THE INVENTION

The present invention has improved the conventional tearing method of the wrap film with a serrated strip by using a new cutting device that comprises a sliding saddle, two protection terminals and a cardboard dispenser box with a pre-pressed guiding track slot. The tearing tool of the conventional method is a metal serrated strip installed openly, while the method of the present invention is a concealed plastic cutting device.

According to the present invention, the force applied through the cutting device is not directly related to the extensibility of the wrap film; therefore, the edge portion of the film cut is smooth and neat, and the force-applying point can also be precisely controlled so as to control the dimensions of the film cut without wasting the film, and therefore it is deemed a feature of the present invention.

Another feature of the present invention is that a safety razor is mounted in the inner sides of the midprop and the top of the sliding saddle (i.e., the inner space of the sliding saddle). Since the safety razor is tucked away, the user's finger would not directly touch the safety razor; therefore, the operation safety of the present invention is relatively improved.

According to the present invention, the outer surface of the device has no any pointed or projected parts, and therefore there is no possibility of causing injury or injuries by sting, scratching or cutting.

BRIEF DESCRIPTION OF THE DRAWINGS

FIG. 2-1 illustrates the procedures of peeling off the perforated sealing strip before pulling out the wrap film.

FIG. 3-1 is a sectional view showing the sliding saddle being mounted in the guiding track slot.

DETAILED DESCRIPTION

Figure 2:
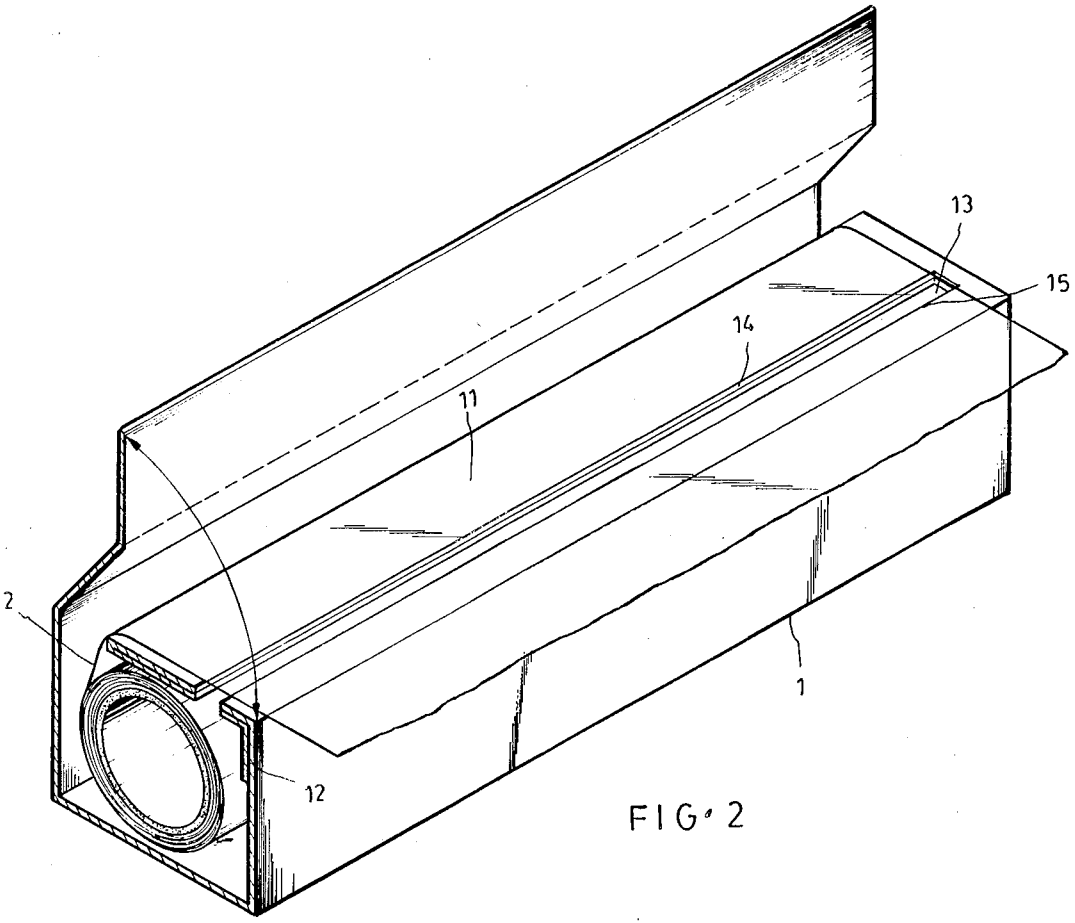
FIG. 2 is a perspective view of the cardboard dispenser box of the wrap film according to the present invention.
Figures 1, 2:
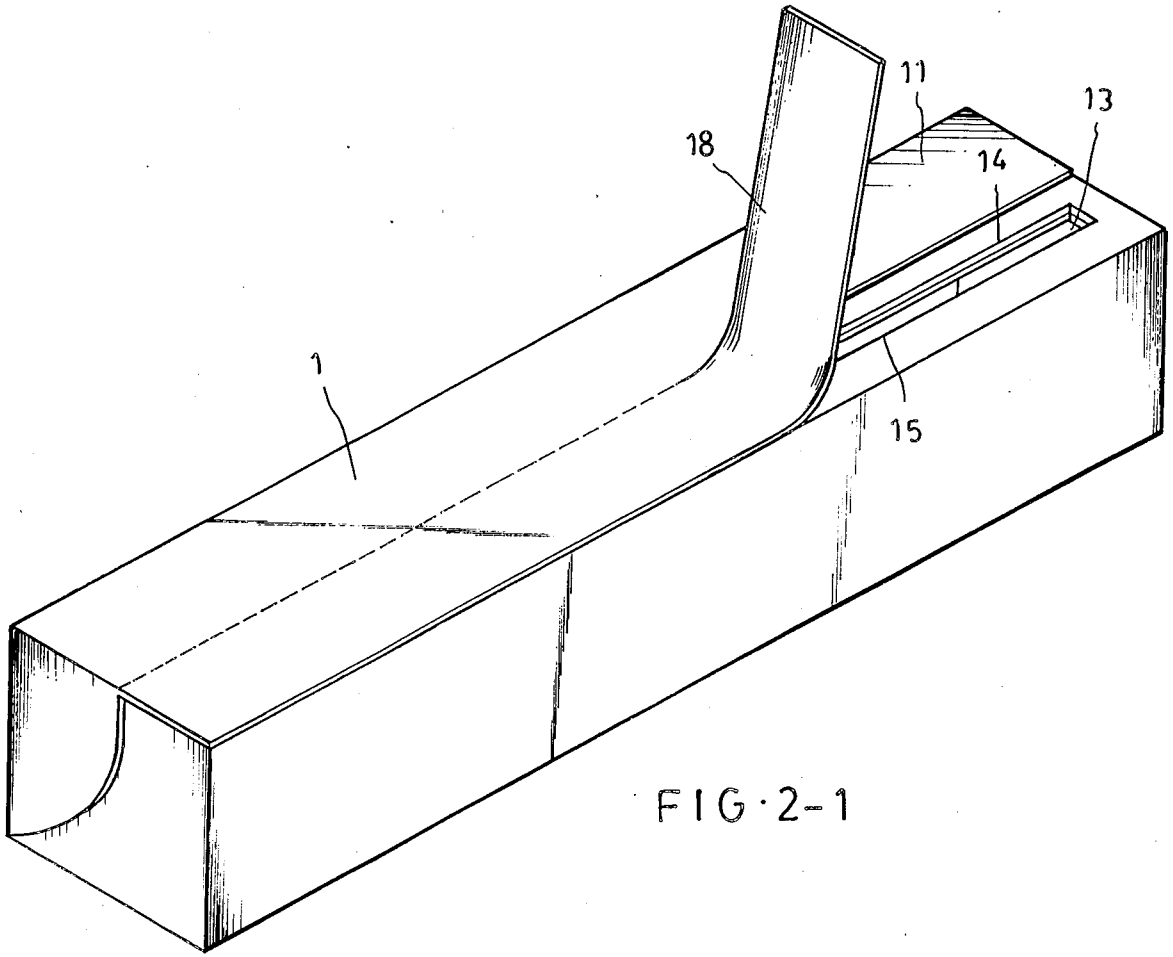

Referring to FIG. 2, there shows a perspective view of the cardboard dispenser box 1 for the wrap film according to the present invention, in which the top portion 11 of the cardboard dispenser box 1 and the side wall portion 12 of the box 1 are made of two layers of cardboards. The top portion 11 is designed with a guiding track slot 13, in which the sliding saddle 3 can be mounted in a sliding manner.

Figure 3:
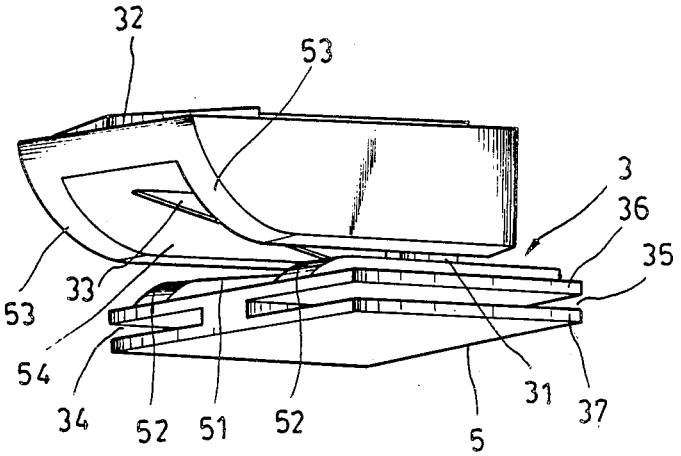
FIG. 3 is a perspective view of the sliding saddle according to the present invention.
Figures 1, 3:
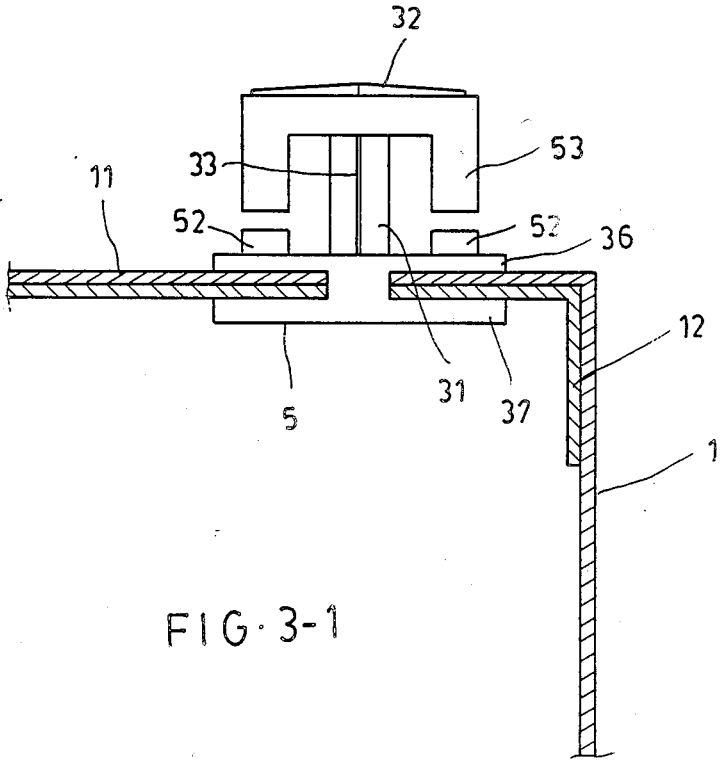

FIG. 3 is a perspective view of the sliding saddle 3 of the present invention, of which the upper half portion is made into a "T" shape, while the lower half portion is made into an I-shaped member 5. Both the upper half portion and the lower half are connected together by means of a mid-prop 31. The top surface of the sliding saddle is furnished with a direction indicator 32 to indicate the moving direction of the sliding saddle 3. Inside the sliding saddle 3, a sharp safety razor 33 is mounted in front of the mid-prop 31 for cutting the wrap film 2. Two guide channels 34 and 35 on the both sides of the lower I-shaped member 5 are formed by the junction of two wings 36 and 37 with the side edges 14 and 15 of the guiding track slot 13 engaged into the two guide channels 34 and 35, the sliding saddle 3 can be supported in a sliding manner; hence the sliding saddle 3 will be able to slide back and forth along the guiding track slot 13 on the top portion 11 of the dispenser box 1. On the top surface of the upper wing 36 of the I-shaped member 5, there are two flanges 51 disposed in parallel each other; the front ends of the flanges 51 are formed into two curved surfaces 52 respectively so as to form into two trumpet-shaped openings 54 with the front curved surfaces 53 of the upper half portion of the sliding saddle 3; that the two trumpet-shaped openings 54 would facilitate the wrap film 2 to be guided into the sliding saddle 3 and to be cut with the safety razor 33 inside the sliding saddle.

Figures 4, 5:
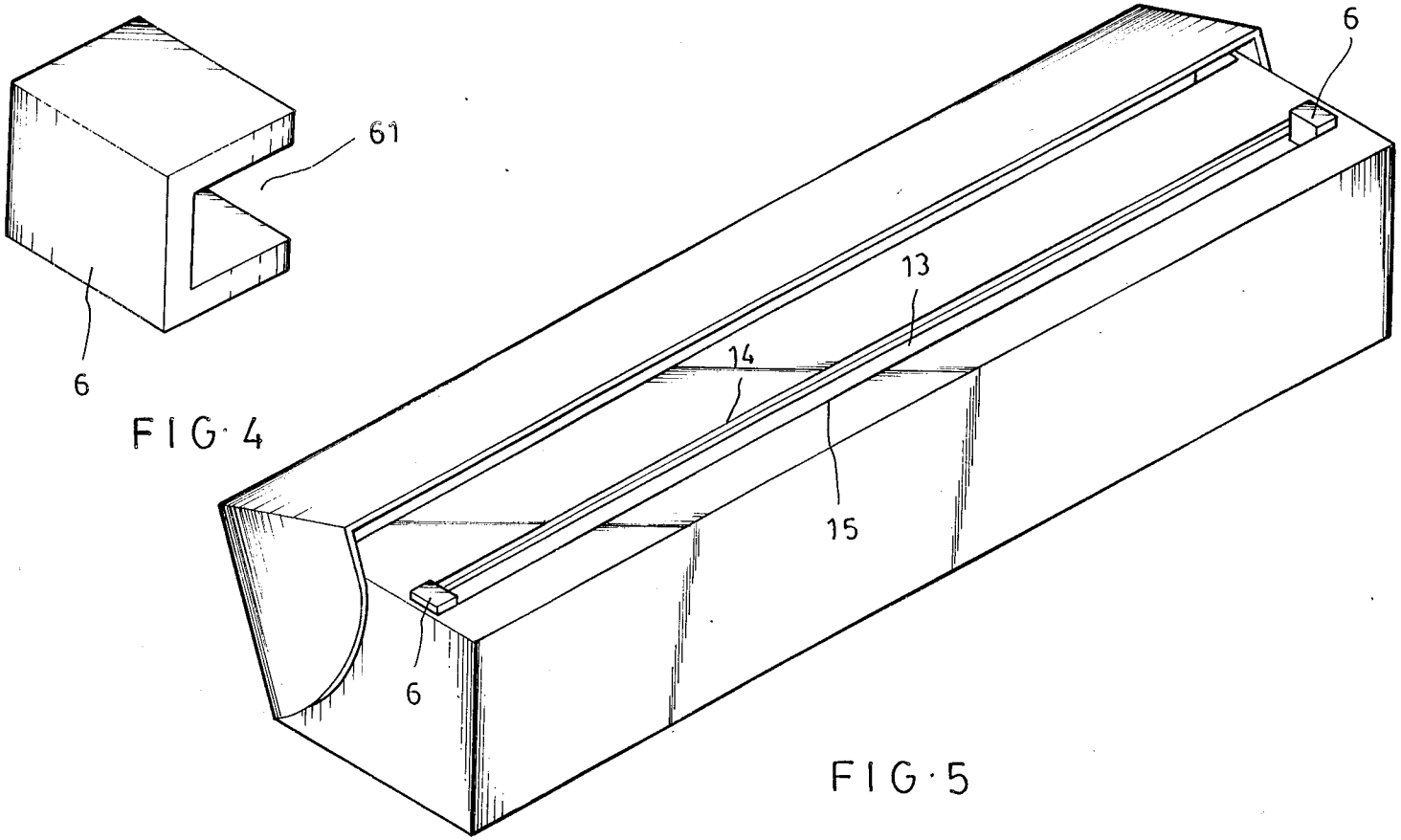
FIG. 4 is a perspective view of the protection terminal according to the present invention.
FIG. 5 illustrates the protection terminals of the present invention being mounted at the two ends of the prepressed guiding track of the dispenser box.

FIG. 4 is a perspective view of the protection terminal 6 of the present invention; the " "-shaped terminal 6 has a channel 61. According to the present invention, there are two protection terminals 6 to be mounted at the both ends of the guiding track slot 13 as shown in FIG. 5 for protecting the two ends of the cardboard guiding track slot 13, of the cardboard box from being damaged and eliminated by the frequent collisions of the sliding saddle 3 that moves back and forth.

Figure 1:
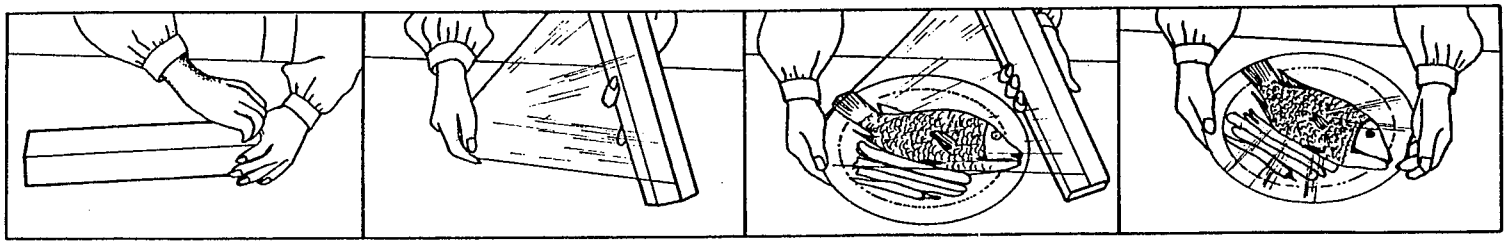
FIG. 1 PRIOR ART
FIG. 1 is a flow chart, showing how to use a conventional wrap film.
Figure 6:
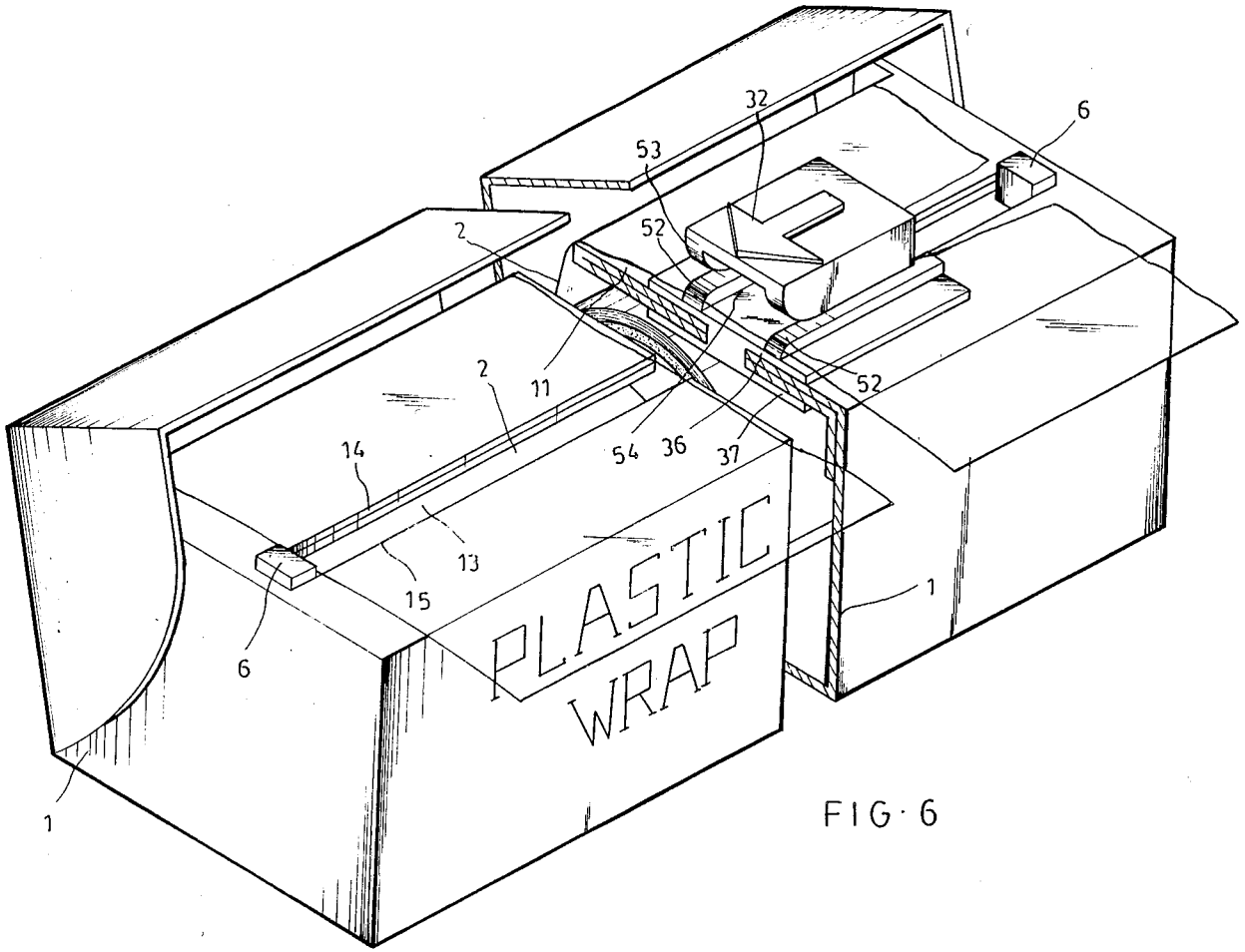
FIG. 6 illustrates the embodiment of the present invention being operated in real use.

FIG. 6 illustrates the embodiment of the present invention being operated in real use. First, peel off the seal strip 18 on the dispenser box 1 to have the guiding track slot 13 appeared as shown in FIG. 2-1. The two protection terminals 6 are then mounted on the both ends of the guiding track slot 13 respectively; the two side edges 14 and 15 of the guiding track slot 13 are engaged with the two guide channels 34 and 35 of the I-shaped member 5 respectively so as to have the sliding saddle 3 be supported by, and can be slid along the guiding track slot 13 freely by user's finger. Before cutting the wrap film 2, push the sliding saddle 3 to one end of the guiding track slot 13, pull the wrap film out of the dispenser box 1, cross the guiding track slot 13 and cover over the food container desired; then, push the sliding saddle 3 downwards by user's finger, and the wrap film 2 will be guided into the trumpet-shaped openings 54 of the sliding saddle 3 as a result of the flat and curved surfaces 52 and 53 of the flanges 51 and the upper half portion of the sliding saddle 3. The wrap film 2 which crosses the guiding track slot 13 will be cut by the safety razor 33 simultaneously when the sliding saddle 3 is pushed downwards. The whole operation of the present invention is simple and safe.

I claim:

1. An apparatus for cutting plastic wrap film comprising:

a cardboard dispenser box having a top portion and one side wall portion made of two layers of cardboard, said top portion having a horizontal guiding track slot formed thereon, said slot having two side edges, a sliding saddle having an upper portion being generally T-shaped in cross section and a lower portion being generally I-shaped in cross-section, a top surface of said sliding saddle having a direction indicator thereon, said upper portion having a horizontal portion and a vertical portion, said lower portion having an upper horizontal portion, a lower horizontal portion, and a vertical portion connecting said upper horizontal portion and said lower horizontal portion of said lower portion of said sliding saddle thereby defining two guide channels between said upper horizontal portion and said lower horizontal portion of said lower portion of said sliding saddle, said two guide channels respectively engaged with the two side edges of said guiding track slot, said vertical portion of said upper portion of said sliding saddle being fixed to said upper horizontal portion of said lower portion of said sliding saddle, a safety razor blade mounted beside said vertical portion of said upper portion for cutting the wrap film, said upper horizontal portion of said lower portion having two flanges formed thereon, each said flange having a curved surface formed on a front end of each said flange, said upper portion of said sliding saddle having two front curved surfaces formed on two front ends of said horizontal portion of said upper portion with each said front curved surface on said horizontal portion of said upper portion corresponding to each said curved surface of said flange on said upper horizontal portion of said lower portion defining an opening to receive the wrap film, and two protection terminals each having a channel mounted on either end of two opposite ends of said guiding track slot on said cardboard dispenser box, whereby upon a depression and sliding movement of said sliding saddle along said guiding track slot the wrap film received in said opening is cut by said safety razor blade.

* * * * *